United States Patent [19]

Wang

[11] Patent Number: 4,773,120

[45] Date of Patent: Sep. 27, 1988

[54] POLISHER WITH AN AIR PUMPING DEVICE

[76] Inventor: Ta-Chin Wang, No. 269 An Ho Rd Sec. 2., Tainan, Taiwan

[21] Appl. No.: 97,041

[22] Filed: Sep. 16, 1987

[51] Int. Cl.[4] ..... A47L 11/14

[52] U.S. Cl. ..... 15/344; 15/29; 15/97 R; 15/339; 51/170 T; 51/177

[58] Field of Search ..... 15/339, 344, 385, 29, 15/97 R; 417/415, 417, 313; 51/170 T, 177; 134/30, 40, 39

[56] References Cited

U.S. PATENT DOCUMENTS

| | | | |
|---|---|---|---|
| 3,128,581 | 4/1964 | Tosetti | 51/177 |
| 4,000,538 | 1/1977 | Tissier | 15/385 |
| 4,084,281 | 4/1978 | Smith | 15/29 |
| 4,091,577 | 5/1978 | Ortiz | 51/170 T |
| 4,216,630 | 8/1980 | Smart et al. | 51/170 T |
| 4,656,687 | 4/1987 | Wei | 15/344 |

FOREIGN PATENT DOCUMENTS

| | | | |
|---|---|---|---|
| 2463605 | 4/1981 | France | 15/29 |
| 1088384 | 12/1954 | Fed. Rep. of Germany | 51/170 T |
| 1289450 | 2/1969 | Fed. Rep. of Germany | 51/170 T |

*Primary Examiner*—Harvey C. Hornsby
*Assistant Examiner*—J. Dwight Poffenberger, Jr.
*Attorney, Agent, or Firm*—Holman & Stern

[57] ABSTRACT

A portable polisher with an air pumping device. It comprises a cabinet and a base combined together in which are contained a motor decelerating construction and an air pump driven by said motor decelerating construction, a polishing wheel with a fixing disc under the base turned by a spindle connected with the motor decelerating construction and protruding through under the base. A tubing system connected with the air pump can supply compressed air both for air pumping in a tire and for polishing with sprayed liquid wax and hot air heated by a heater inside the polishing wheel.

5 Claims, 3 Drawing Sheets

POLISHER WITH AN AIR PUMPING DEVICE

BACKGROUND OF THE INVENTION

Nowadays the standard of living has been developed much higher than before as incomes of people has been increased, and automobiles have also become popular and widely used. Then the safety in driving a car has an important relation with the air pressure in the tire, and most car owners generally likes to keep their cars in a cleaned, bright condition.

Checking and air pumping tires are commonly done by a garage or a filling station, and cleaning and polishing a car is also done by a car service station, but some people do these works with their own hands, using tools. Nevertheless, most tools used for polishing or air pumping are not so convenient having the following disadvantages.

1. Conventional portable air pumps are either manual or eletric, and manual ones need considerable strength, not so practical for car tires, while electric ones are rather expensive having only one function.

2. Cleaning and polishing a car takes rather much time and work if done manually, and an electric polisher has only one function in spite of its space for storing.

3. Tools for air pumping and polishing has become nearly indispensable for a car owner recently, but it may not pay to get separate tools for these works.

Therefore, the inventor has worked out this polisher with an air pumping device mainly for cars, portable, compact and easy to handle.

SUMMARY OF THE INVENTION

This invention, a polisher with an air pumping device is equipped with two functions, polishing and air pumping. It includes a cabinet and a base combined together for contain a motor decelarating construction and an air pump in the space formed by the cabinet and the base, a polishing wheel set under the base turned by a spindle protruding under the base. The air pumping device comprises the air pump and a tubing system of several tubes, T valves, an air nozzle for pumping air in a tire and a blowing tube for spraying liquid wax on a car body and blowing out hot air for polishing. besides, a wax box is placed on the cabinet and wax can be warmed up by a heater inside the cabinet to turn jelly-like wax into liquid which is led by a tube to flow down into the polishing wheel and finally is sprayed out of the wheel on something for polishing.

BRIEF DESCRIPTION OF THE DRAWINGS

FIG. 2-1 is an upside view of this polisher with an air pumping device in the air pumping condition in this invention.

DETAILED DESCRIPTION OF THE INVENTION

Figure 1:
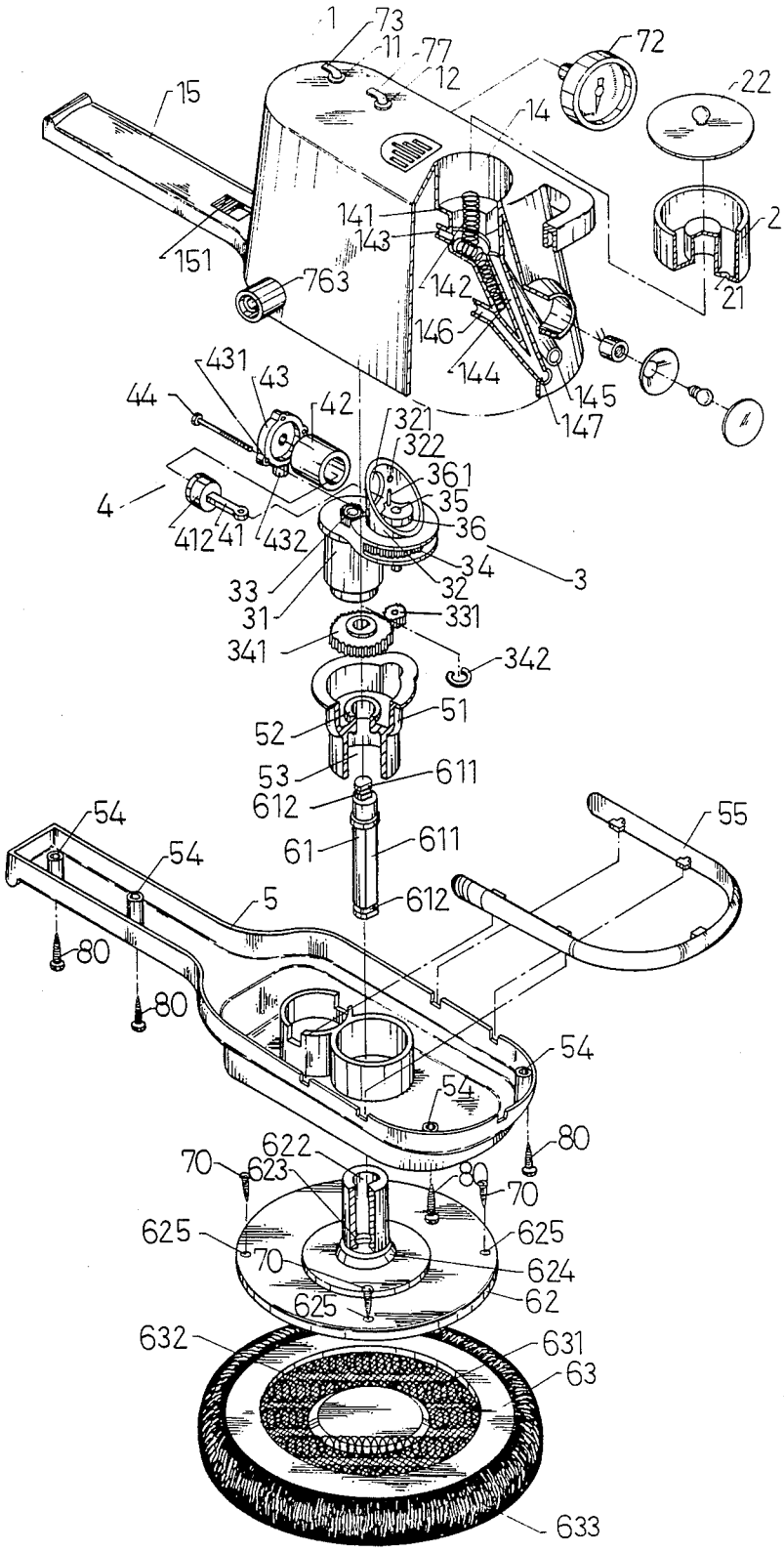
FIG. 1 is an explosive perspective of the polisher with an air pumping device in this invention.

This invention, a polisher with an air pumping device, comprises cabinet 1, wax box 2, motor decelarating construction, air pump 4, base 5 and polishinh construction 6 as its main parts as shown in FIG. 1.

As FIG. 1 shows, cabinet 1 has two holes 11, 12, big hole 213, opening 14 and handle 15; opening 14 is set with protruding edge 141, heater 142, air-in tube 143, air-out tube 144 and air exit 145 properly arranged at its lower section; air-in tube 143 and air exit 145 are connected with each other, and then air exit 145 extends out of cabinet 1; air-out tube 144 is connected with blowing tube 146 which has a nozzle extending out of cabinet 1; electric switch 151 is properly fixed on handle 15.

Wax box 2 is set on opening 14 of cabinet 1, with lid 22 covering wax box 2 and with round 21 hole bored suitably in the bottom f wax box 2.

Motor decelarating construction 3 comprises motor 31, gear base 32, small gear 33, big gear 34, output shaft 35 and krank 36 combined together; the shaft of motor 31 is fixed on with samll gear 33; big gear 34 is connected on output shaft 35 which is fixed properly on gear base 32; small gear 33 and big gear 34 engage with each other; krank 36 is fixed on the top end of output shaft 35, having secondary shaft 361 upwardly on it, and in the vertical wall of gear base 32 opposite secondary shaft 361 is round hole 321 and a plurality of screw holes 322; on the lower end of output shaft 35 is set small gear 331 engaging with secondary gear 341.

Air pump 4 is constituted with connecting rod 41, cylinder 42, cylinder cap 43 and screws 44 combined together; at one end of said rod 41 is attached with piston 412; a plurality of holes 431 are bored in cylinder cap 43 and air-out tube 432 is set through the under side of cylinder cap 43.

Base 5 contains at its center concave base 51 in which small gear 33 and secondary gear 341 engaging with each other are settled, and which extends towards underside to form spindle hole 52 and connecting hole 53; a plurality of combining holes 54 are bored in base 5 to combine base 5 with cabinet 1 as one unit with U-shape cushion set between the both, cabinet 1 and base 5.

Polishing construction 6 includes spindle 61, fixing disc 62 and polishing wheel 63 combined together; spindle 61 is formed with flat side 611 of a proper length and ring goove 612 set at both ends; fixing disc 62 is formed with protruding upward post 621 at its center and said post 621 has central hole 622 for being combined with or taken apart the spindle 61 and engaging ring 623 is set in the central hole 622; copper ring 624 for transmitting electricity is set on fixing disc 62 and several combining holes 625 bored around the edge of fixing disc 62; polishing wheel has heater 631 set inside, many air holes 632 bored on its surface and velvet cloth 633 for ploishing attached around its round edge. Velvet cloth 633 can be taken place by other materials.

Figures 1, 2:
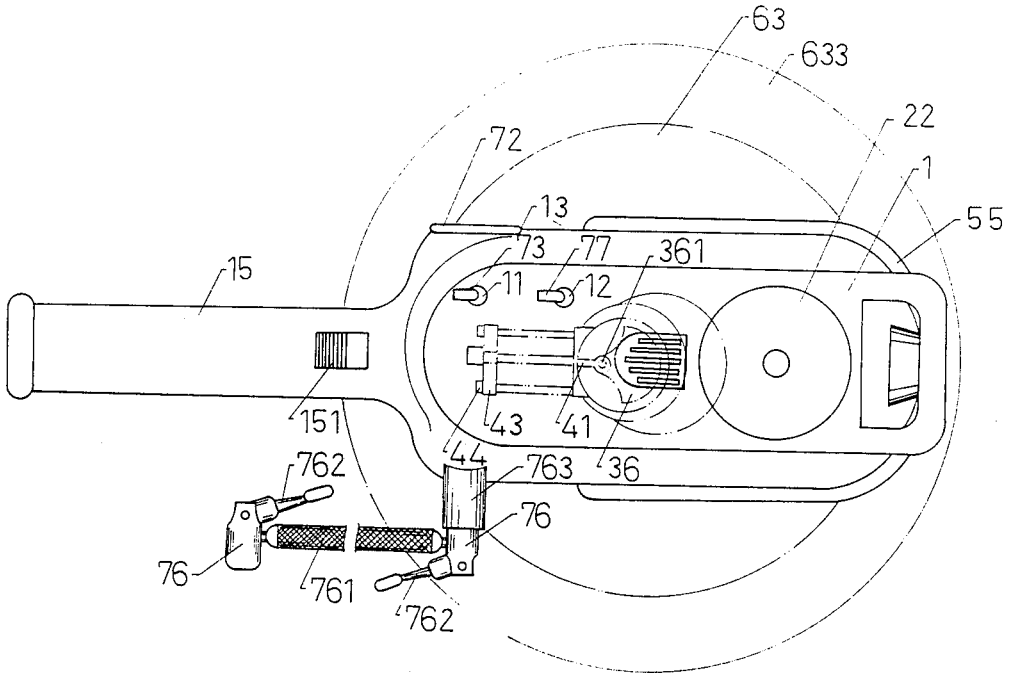
FIG. 2 is a cross-sectional view of this polisher with an air pumping device in the polishing condition in this invention.
Figure 2:
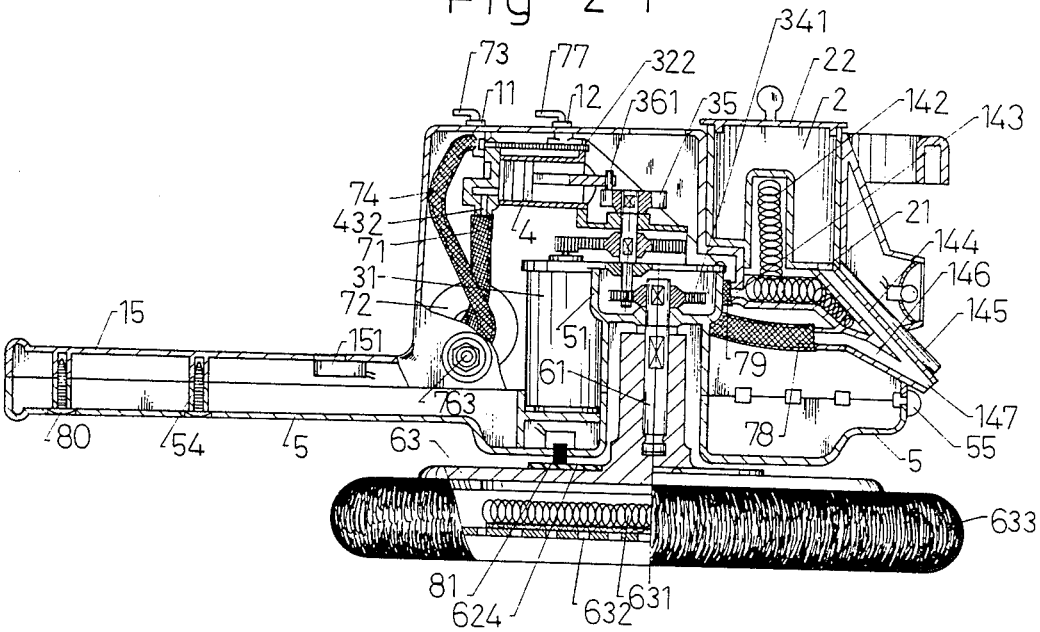

Now FIGS. 2 and 2-1 are to be referred to. First, in combining together this invention, screws 70 are inserted through combining holes 625 of fixing disc 62 and screwed into polishing wheel 63 to combine the both, fixing disc 62, and polishing wheel; spindle 61 is inserted from under to upward through spindle hole 52 of base 5 and C-shape catching ring 342 is put at the upper end of spindle 61 to catch hold of spindle 61 in order to prevent secondary gear 341 from loosening off spindle 61, and the lower end of spindle 61 is to be combined with or taken apart hole 622 of fixing disc 62; in case of combining them engaging ring 623 in hole 622 is put around ring groove 612 of spindle 61 catching hold of spindle 61 at its place. Next, motor decelarating construction 3 with its related parts combined together is to be fixed by concave base 51 of base 5; then small gear 331 engages with secondary gear 341 to transmit revolution to spindle 61. Connecting rod 41 of air pump 5 is combined together with krank 36 by secondary shaft 361 of krank 36 inserting upwardly in hole 411 of connecting rod 41; cylinder 42 is combined at one end with cylinder cap 433 with screws 44 screwed through holes 431 of said cylinder cap 43 and holes 322 of gear base 32, and the other end of cylinder 42 stays in hole 321; then air pump 4 has been assembled all together. Lastly, U-shape cushion 55 is to be put and engaged with the edge of base 5 by screws being screwed in combining holes 54 of base 5, and then base 5 is to be assembled together with cabinet 1; wax box 2 is then put on opening 14 of cabinet 1, with round hole 21 set aligned to air-out tube 144 and finally lid 22 is covered on wax box 2 after jelly-like wax has been put in said wax box 2.

Figure 3:
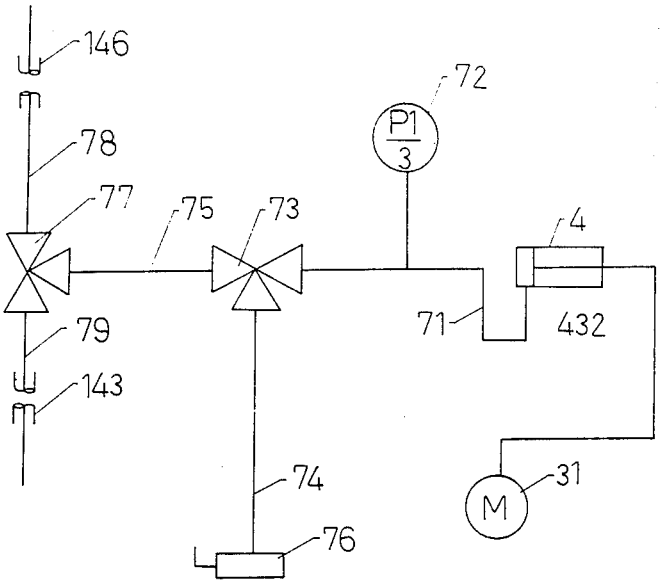
FIG. 3 is a diagram of the tubing system used in this polisher with an air pumping device.
Figure 4:
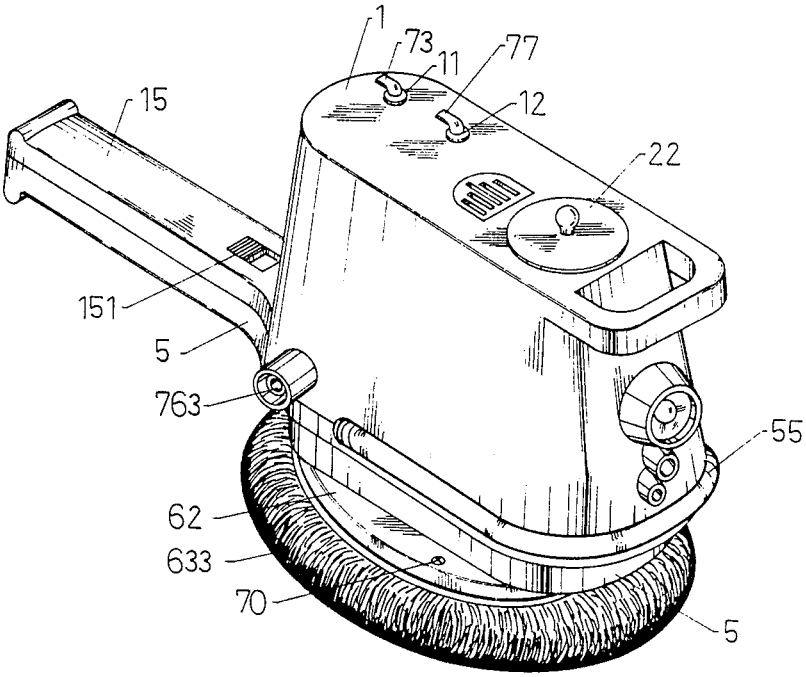
FIG. 4 is an outward view of this polisher with an air pumping device.

Now FIG. 3 shows the diagram of the tubing system used in this invention. Soft tube 71 is connected with air-out tube 432 of air pump 4, and pressure gauge 72 is connected at a proper point. The other end of soft tube 71 is connected with T valve 73 with which soft tubes 74, 75 are separately connected; soft tube 74 is connected with air-out head 763 with which air nozzle 76 with clip 762 is connected; soft tube 75 is connected with another T valve 77 with which soft tubes 78, 79 are connected; soft tube 78 is then connected with blowing tube 146, while soft tube 79 is connected with air-in tube 143. T valves 73, 77 are separately connected with holes 11, 12, pressure gauge 72 is fitted on big hole 13 of cabinet 1, and air nozzle 76 connected with air tube 761 and another nozzle 76 can be pulled out of cabinet 1 to simplify the air pumping operation.

After all the parts of this invention have been assembled together, motor decelarating construction 3 can simultaneously moves air pump 4 to produce compressed air and polishing construction 6 to perform polishing work, so this invention has double functions. Heater 142 at the bottom of opening 14 can warm and turn jelly-like wax into liquid so that liquid wax can flow through round hole 21 to exit tube 144 and be sprayed out of nozzle 147 being blown by compressed air coming put of blowing tube 146. But if the air blown into air-in tube 143 is heated by heater 142 becoming hot air, it is to go out of air exit 145. Electric brush 81 is set at a proper point under base 5 keeping touch with copper ring 624 of fixing disc 62 whether in a revloving or stationary condition so that heater 631 in polishing wheel can get electricity to heat up air which flows out of air holes 632 to upgrade the shining of the wax sprayed on the place polished, with the air of hot air coming out of air exit 145.

In general, this polisher with an air pumping device has the advantages listed below.

1. Double functions for air pumping and polishing to satisfy the desire of most consumers.

2. The same compressed air that the air pump gives out can be used separately either for pumping into a tire or spraying the wax and blowing hot air in performing the polishing work smoothly.

3. The heater set in the polishing wheel can produce suitable heat to heat up the air around it, and the hot air is to be sent out of the air exit to warm up the wax sprayed on the place being polished, so the shining result can be got.

4. Low in cost, simple in use and easy to carry.

What is claimed is:

1. A polisher with a air pumping device comprising:

a motor decelerating construction assembled with a motor, a gear base, a small gear, a big gear, an output shaft, a crank, said small gear connected on the shaft of said motor, said output shaft combined in said gear base, said big gear fixed on said output shaft and engaging with said small gear, said crank fixed at the top end of said output shaft, a secondary shaft fixed suitably on said crank, a round hole and a plurality of screw holes bored in a vertical wall of said gear base just opposite to said secondary shaft;

an air pump consisting of a connecting rod, a cylinder, a cylinder cap and a plurality of screws, a round hole set at one end of said connecting rod for combining with said secondary shaft of said crank, a piston set at the other end of said connecting rod for being combined and reciprocated in said cylinder, the one end of said cylinder fixed with said cylinder cap by screws inserted traversely through the holes of said cylinder cap and screwed in the screw holes of said gear base so that said air pump can be fixed on said gear base, said piston can be reciprocated by said crank to produce compressed air in said cylinder and the compressed air can be sent out of the air exit of said cylinder into a soft tube with a pressure gauge set at a proper point and;

the characteristics that a small gear set on the lower end of said output shaft engages with a secondary gear set on a spindle in a base to turn a polishing construction connected with said spindle, that a T valve connected with one end of a soft tube connected with the air-out tube of said air pump are connected with two soft tubes, and one of said two soft tubes connected with a air nozzle for pumping air out can be pulled out of a cabinet of this polisher, while the other of said two soft tubes is connected with another T valve which is connected with two soft tubes, and one of said soft tubes is connected with a blowing tube of the cabinet connected with the wax exit of said wax box to help spray the liquid wax coming out of the wax exit to the body surface of a car or a floor, but the other of said two soft tubes connected with an air-in tube which blows hot air heated by a heater under said wax box out of an air exit for warming up the place being polished.

2. The polisher with an air pumping device as claimed in claim 1, wherein the cabinet has;

two combining holes for connecting a T valve each, a big round hole for connecting a pressure gauge, an opening having a protruding edge set at its proper lower section, a heater, an air-in tube and an air exit set between said protruding edge and the bottom of the cabinet, an exit tube set from said protruding edge to the outside of the cabinet, a blowing tube connected with said exit tube for spraying liquid wax and, a handle fixed at one side of said cabinet having an electric switch set on it.

3. The polisher with an air pumping device as claimed in claim 1, wherein said wax box has a lid to be put on said opening, the cabinet has a round hole set in its bottom facing against said exit tube at said protruding edge in said opening, and the jelly-like wax warmed up by the heater turns into liquid wax, which flows through said round hole to said exit tube to be sprayed out to the body surface of a car or something.

4. The polisher with an air pumping device as claimed in claim 1, wherein said base includes a concave base set inside for containing a small gear and a secondary gear engaging with each other, a spindle hole and a connecting hole set extending towards underside of the base and a plurality of combining holes properly set on it.

5. The polisher with an air pumping device as claimed in claim 1, wherein said polishing construction comprises:

a spindle set with a flat side and a ring groove separately at both ends, combined in the spindle hole inserted from under said connecting hole of said base, a C-shape catching ring set in said ring groove to prevent said secondary gear from loosening off said spindle on whose upper end said secondary gear is set, said secondary gear engaging with a small gear set on the lower end of said output shaft of said motor decelarating construction;

a fixing disc with a protruding post forming at its center which has a hole for combining with or taking apart said spindle, said protruding post to be settled in said connecting hole of said concave base, said hole having an engaging ring set in the proper place inside, a copper ring set at a proper place on said fixing disc for transmitting electricity;

a polishing wheel set with a heater and air holes inside, with velvet cloth for polishing set around its edge, to be combined together with said fixing disc, whose protruding post is to be settled in said connecting hole of said concave base, and whose hole for combining with or taking apart said spindle is to be inserted by said spindle so that said fixing disc and polishing wheel may not loosen off said spindle; and the function that said heater inside said polishing wheel can get electricity transmitted by said copper ring touching with an electric brush fixed under said base, giving out heat to warm up the air around it which is then blown out to warm the liquid wax sprayed out on the car body or the floor, in addition to the polishing work done by said polishing wheel turning.

* * * * *